US008092056B2

(12) United States Patent
Brendle et al.

(10) Patent No.: US 8,092,056 B2
(45) Date of Patent: Jan. 10, 2012

(54) LIGHT MODULE AND LIGHTING DEVICE

(75) Inventors: Matthias Brendle, Tuebingen (DE); Michael Hamm, Eningen u.A. (DE); Ernst-Olaf Rosenhahn, Bodelshausen (DE); Heike Froehlich, Reutlingen (DE)

(73) Assignee: Automotive Lighting Reutlingen GmbH (DE)

( * ) Notice: Subject to any disclaimer, the term of this patent is extended or adjusted under 35 U.S.C. 154(b) by 114 days.

(21) Appl. No.: 12/729,680

(22) Filed: Mar. 23, 2010

(65) Prior Publication Data

US 2010/0246201 A1 Sep. 30, 2010

(30) Foreign Application Priority Data

Mar. 24, 2009 (DE) ..... 10 2009 014 142

(51) Int. Cl.
*F21V 19/00* (2006.01)

(52) U.S. Cl. ..... 362/519; 362/549; 362/316

(58) Field of Classification Search ..... 362/507, 362/516, 519, 548, 549, 306, 296.1, 341
See application file for complete search history.

(56) References Cited

U.S. PATENT DOCUMENTS

| | | | | |
|---|---|---|---|---|
| 1,848,812 | A * | 3/1932 | Wiley | 362/208 |
| 2,034,512 | A * | 3/1936 | Gelger et al. | 362/519 |
| 6,089,735 | A * | 7/2000 | Lee | 362/507 |
| 2006/0056187 | A1 * | 3/2006 | Koegler et al. | 362/341 |

* cited by examiner

*Primary Examiner* — Laura Tso
(74) *Attorney, Agent, or Firm* — Donald R. Boys; Central Coast Patent Agency, Inc.

(57) ABSTRACT

The invention relates to a light module (1) for a lighting device for a motor vehicle. The lighting module (1) comprises a light source (3) for emission of electromagnetic radiation, preferably in the form of light which is visible for the human eye, and a reflector (2) for focusing the emitted radiation. At its apex, in the area of its optical axis (8), the reflector (2) has an opening (7) for holding a light-emitting part (5) of the light source (3). A reflector neck (9) is formed on the reflector (2), surrounding at least a part of the holding opening (7), to which reflector neck (9) another part (4, 6) of the light source (3) is attached. In order to reduce the installation space required for lighting devices in a motor vehicle, it is proposed that the reflector (2) has a slot (17), which extends into the holding opening (7), below the holding opening (7), the width of which slot (17) transversely with respect to the optical axis (8) of the reflector (2) is greater than the width of the light-emitting part (5) of the light source (3). The lamp (3) can therefore be replaced more easily, and in less space.

14 Claims, 7 Drawing Sheets

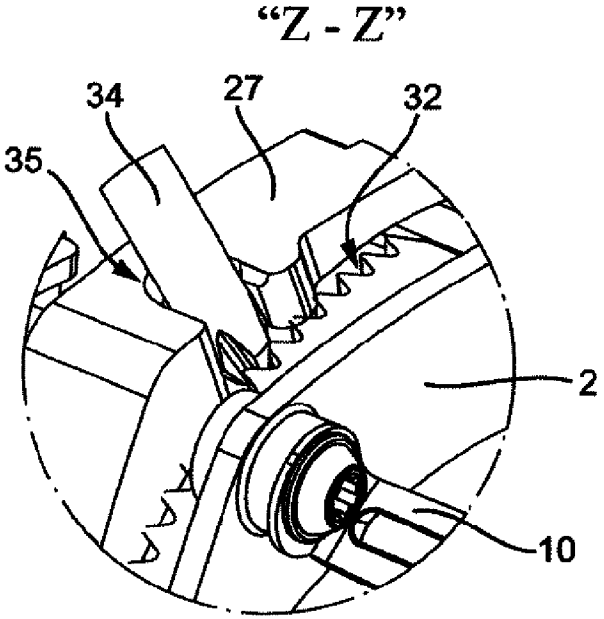
Fig. 14
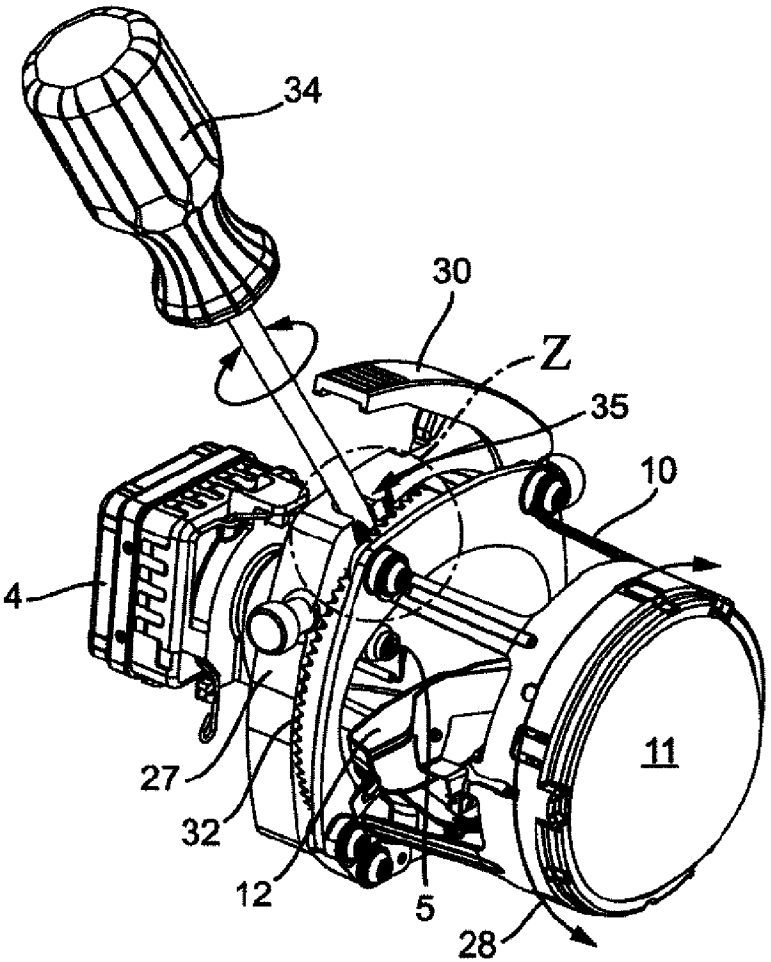

LIGHT MODULE AND LIGHTING DEVICE

CROSS-REFERENCE TO RELATED DOCUMENTS

The present application claims priority to German patent application serial number 10 2009 014 142.1, which was filed on Mar. 24, 2009, which is incorporated herein in its entirety, at least by reference.

DESCRIPTION

The present invention relates to a light module for a lighting device for a motor vehicle. The light module comprises a light source for emission of electromagnetic radiation, preferably in the form of light which is visible for the human eye, and a reflector for focusing the emitted radiation. At its apex in the area of its optical axis, the reflector has an opening for holding a light-emitting part of the light source. A reflector neck is formed on the reflector, surrounding at least a part of the holding opening, to which reflector neck another part of the light source is attached. The invention also relates to a lighting device for a motor vehicle, in particular a motor vehicle headlight, having a light module of said type.

Increasingly stringent requirements for the functionality, safety and performance of motor vehicles as well as the multiplicity of auxiliary appliances associated with them are leading to the vehicle physical area being heavily overloaded, particularly in the area of the engine compartment. A relatively large proportion of the available physical area in the so-called front end of a motor vehicle is occupied by the headlights. In particular, conventional projection headlights, so-called PES (poly-ellipsoid system) headlights, have a relatively deep structure. In the case of conventional headlights, the axially installed light sources and the physical space required behind the lamp for lamp replacement, require a particularly large amount of space. The known PES headlights have light sources which, for example, are in the form of type D1, D1$^+$ or D3 gas discharge lamps, with a relatively narrow but very long glass bulb in which an arc is produced. In the case of conventional PES headlights, the light source must be drawn out of the reflector over its entire length, essentially parallel to the optical axis of the reflector, before it can be removed.

Against the background of the described prior art, the present invention is therefore based on the object of designing a light module or a lighting device which is physically particularly small, in particular with a small installation depth, in order that more space is available for other auxiliary appliances in the available vehicle physical area, or the already existing appliances can be arranged in a clearer form in the vehicle.

Against the background of the light module of the type mentioned initially, it is proposed, in order to solve this problem, that the reflector has a slot, which extends into the holding opening, below the holding opening, the width of which slot transversely with respect to the optical axis of the reflector is greater than the width of the light-emitting part of the light source.

Once the reflector has been released, the light source can be removed directly downward through the slot. Immediately after being released from the reflector, the lamp is pivoted about a virtual rotation axis, which runs on the rear face of the reflector, for example in the area of the reflector neck, essentially horizontally and transversely with respect to the optical axis. During this process, the glass bulb of the lamp is pivoted downward through the slot, and the lamp igniter is pivoted upward. The lamp is therefore pivoted transversely with respect to the optical axis and transversely with respect to the longitudinal axis of the lamp, and is then removed upward, transversely with respect to the optical axis and parallel to the longitudinal axis of the lamp.

According to the invention, it has therefore been identified that the physical space required behind the light module for lamp replacement can be reduced by not having to draw the light source out of the reflector over its entire length, but by removing it by tilting. The slot in the reflector is provided for this purpose, through which the glass bulb of the lamp can be passed out of the reflector internal area to the outside during the tilting process. This measure allows the physical space required in the longitudinal direction for lamp replacement to be reduced considerably, or even to be completely obviated.

Since the lower reflector section, in particular the center area immediately below the holding opening for the glass bulb, is of secondary importance for lighting purposes, that is to say it has scarcely any effects on the formation of the light distribution, the configuration of the slot in this area has no major consequences on the resultant light distribution. There are virtually no reductions in the lighting because of the slot.

It is feasible for other areas of the reflector to be designed such that they reflect light emitted from the light source to where the lower reflector area would have reflected the light had there been no slot. This makes it possible to compensate for even minor adverse affects on the light distribution caused by the slot.

The slot may be chosen to have virtually any desired length. Even a relatively short slot can have major effects on the shortening of the physical space required for lamp replacement on the rear face of the light module, since the lamp can be withdrawn from the reflector at an angle. In particular, a slot with a length of approximately half the length of the glass bulb (measured from the distal end of the bulb to the shank on the igniter) on its own allows a considerable reduction in the physical space required for lamp replacement. The length of the slot particularly advantageously corresponds to the length of the light-emitting part of the light source. In this case, the slot is designed to be sufficiently long that the glass bulb can be pivoted downward through the slot out of the reflector interior over its full length immediately after the light source has been released from the reflector neck.

Alternatively or in addition to the slot, it is feasible for the reflector neck to have a cutout above the holding opening, the width of which cutout transversely with respect to the optical axis of the reflector is greater than the width of the light-emitting part of the light source. This cutout allows the lamp to be removed upward at an even steeper angle. Since the upper reflector area is significant from the lighting point of view, the cutout should, as far as possible, extend only on the reflector neck and not also into the reflection surface of the reflector.

The light module according to the invention is intended in particular for use of a novel gas discharge lamp, with a power of about 25 watts, and a maximum luminous flux of 2000 lumens. This novel gas discharge lamp therefore has a lower power and, as a result of this, a lower luminous flux than the previously known gas discharge lamps. Because of efficiency improvements in the area of the reflector, and other optically effective components in the light module, light modules having the novel gas discharge lamps have an illumination intensity which is comparable to conventional, stronger gas discharge lamps, despite the reduced luminous flux. The low luminous flux precludes dazzling of drivers and passengers coming in the opposite direction or travelling in front caused by scattered light (by dirt on the glass covering the headlight) or by headlights which are aligned too high (as a result of a pitching and tossing movement of the vehicle bodywork). There is therefore no need for automatic beam width control or for the ability to clean the glass covering the lighting device (headlight washing installation). The lighting device according to the invention can therefore be designed to be particularly simple, physically small and cost-effective.

Furthermore, it is feasible for the lighting device according to the invention to have a holding frame on which the light module is mounted such that it can rotate about the optical axis of the reflector between an operating position and a maintenance position. This also allows the removal direction of the lamp to be rotated with the light module, thus making it possible to provide different working directions for lamp replacement. In this case, the holding frame has a mounting for the holding frame, for a control wheel for rotation of the light module, and a latching lever. The control wheel has a tooth system which engages in a toothed rim on the reflector of the headlight insert (light module), and can thus rotate the latter about its optical axis. The latching lever, which at the same time can be latched into the holding frame and the reflector, fixes the horizontally set light/dark boundary of the headlight insert. The control wheel can optionally also be driven via a flexible shaft: it is therefore possible to place the drive for the rotation mechanism largely floating on the headlight housing. A corresponding lighting device is described in detail in DE 10 2008 011 170, which was filed on Feb. 26, 2008. Reference is expressly made to this document, with regard to the construction and method of operation of a lighting device having a light module which can rotate about the optical axis, and the subject matter of this document is intended to be an element of the present application.

Finally, it is also proposed that the lighting device have guide means which guide the light source on its path from the inserted position to the removed position, and vice versa. This allows the light source to be guided throughout the entire removal and insertion process, and it therefore cannot be lost. The guidance process is preferably carried out automatically, as a result of which there is no need for any mechanical action by a worker in a car workshop, or by the vehicle keeper. The drive for automatic guidance may, for example, be provided by means of an electric motor, an electromagnet, hydraulically, pneumatically or even by means of a spring element. In this case, when it is being inserted into the reflector, the light source is moved along the guide means, against the spring force of a spring element. When the light source is being removed, the spring element then ensures that the light module moves along the guide means.

Preferred exemplary embodiments of the invention will be explained in more detail in the following text with reference to the figures, in which:

FIG. 14 shows a perspective view of a sixth preferred embodiment of a light module.

Figure 12:
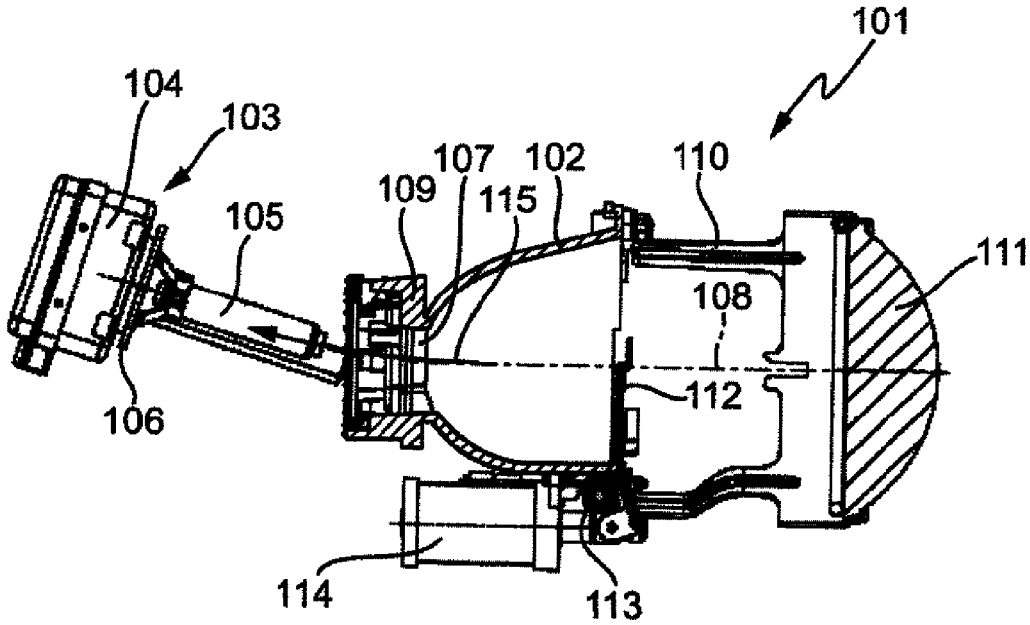
Fig. 12 (Prior Art)
FIG. 12 shows a light module known from the prior art.

The prior art will be described with reference to FIG. 12, in which a known light module is annotated in its totality by the reference symbol 101. The light module 1 is in the form of a so-called poly-ellipsoid system (PES) module. The PES module 101 has a reflector 102, which is shown in the form of a section. In addition, the light module 101 has a lamp 103 which, in the illustrated exemplary embodiment, is in the form of a gas discharge lamp, in particular a so-called D1 lamp. An integral component of the gas discharge lamp 103 is an igniter 104, which is used to ignite and maintain an arc in a glass bulb 105 for the lamp 103. A holding opening 107 for the insertion of the glass bulb 105 for the lamp 103 is formed in the area of an apex of the reflector 102. An optical axis 108 of the reflector 102 preferably runs through the holding opening 107. A reflector neck 109, which surrounds the holding opening 107 at least in places, is formed on the rear face of the reflector 102. The lamp 103 is attached by means of its lamp cap 106 to the reflector neck 109. In this case, the glass bulb 105 projects through the holding opening 107 into the interior of the reflector 102.

A supporting frame 110 for a projection lens 111 is attached to the front edge of the reflector 102. The lens 111 projects the light beams reflected by the reflector 102, in order to produce a desired light distribution on the roadway in front of the motor vehicle. A shutter arrangement 112 is arranged between the reflector 102 and the projection lens 111 and may be composed of one or more shutter elements. The shutter arrangement 112 may be designed to be movable, in order to vary the light distribution of the light module 101. In the illustrated example, the shutter arrangement 112 is designed such that it can pivot about a rotation axis 113 which runs transversely with respect to and below the optical axis 108. An operating member 114, for example in the form of an electric motor or an electromagnet, is provided in order to pivot the shutter 112.

In the case of the known light module 101, it is problematic to replace the light source 103, and the physical space required for this purpose behind the light module 101 is problematic. As can be seen in FIG. 12, in the case of conventional PES light modules 101, in order to remove the light source 103, it must be drawn to the rear out of the reflector 102, virtually parallel to the optical axis 108 and over the entire length of the glass bulb 105. The corresponding movement is indicated by an arrow which is annotated with the reference symbol 115. The physical space required for lamp replacement is intended to be reduced by the present invention.

Figure 1:
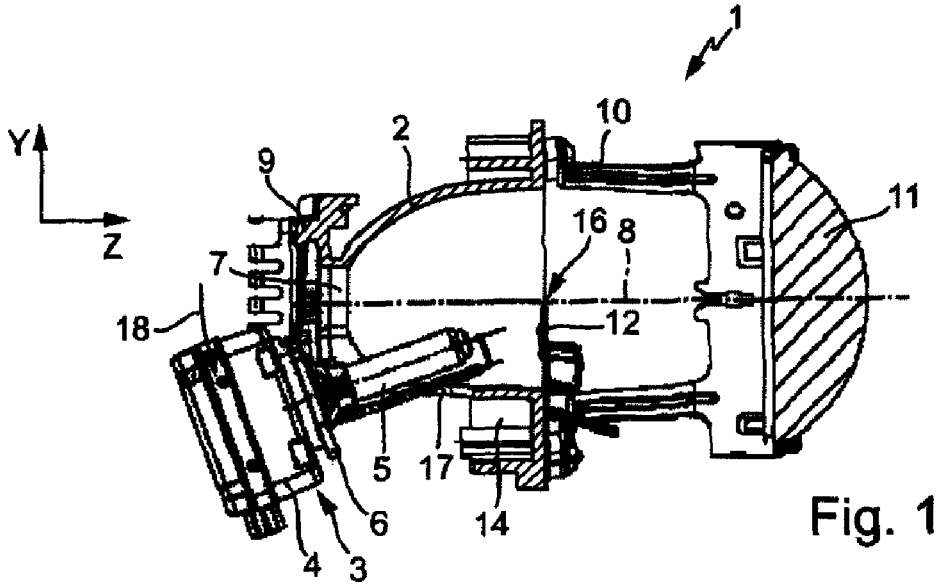
FIG. 1 shows a first preferred embodiment of a light module according to the invention, partially in the form of a longitudinal section.

A light module according to the invention is annotated in its totality in FIG. 1 with the reference symbol 1. The light module 1 is in the form of a so-called poly-ellipsoid system (PES) module. The PES module 1 has a reflector 2, which is made of plastic or metal, for example from a metal diecasting. If it is produced from plastic, a reflective coating is applied at least in the area of the reflection surface of the reflector 2. The reflector 2 is preferably ellipsoid or it has a free shape differing slightly from the ellipsoid shape. The reflector 2 is illustrated in a sectioned form in FIG. 1. In addition, the light module 1 has a lamp 3 which, in the illustrated exemplary embodiment, is in the form of a gas discharge lamp, in particular a so-called D1 lamp. An integral component of the gas discharge lamp 3 is an igniter 4 which is used to ignite and maintain an arc in a glass bulb 5 of the lamp 3. In particular, the igniter 4 is attached in a rotationally fixed manner to the glass bulb 5 and to a lamp cap 6 of the lamp 3. The arc which is produced in the glass bulb 5 of the light source 3 is preferably arranged in the area of a first focal point of the reflector 2 which is in the form of an ellipsoid or is similar to an ellipsoid. A holding opening 7 for insertion of the glass bulb 5 for the lamp 3 is formed in the area of an apex of the reflector 2. An optical axis 8 of the reflector 2 preferably runs through the holding opening 7. A reflector neck 9, which surrounds the holding opening 7 at least in places, is formed on the rear face of the reflector 2. The lamp cap 6 of the lamp 3 is attached to the reflector neck 9. In this case, the glass bulb 5 projects through the holding opening 7 into the interior of the reflector 2.

A front light outlet opening of the reflector 2 is partially covered by a shutter arrangement 12, which is arranged in the light propagation direction in the vicinity of the focal area that is remote from the reflector. The shutter 12 has an upper edge 16 with an asymmetric profile, that is to say an area of the upper edge 16 on one side of a vertical center plane which runs through an optical axis 8 of the reflector 2 is higher or lower than the area of the upper edge on the other side of the center plane. Attachment means 10 are arranged on a front edge of the reflector 2 and hold a projection lens 11 at a defined distance from the reflector 2, such that a focus of the lens 11 is located in the area of the shutter arrangement 12 on the optical axis 8, and the lens 11 is arranged behind the shutter 12 in the direction of light emission. The lens 11 has at least one spherical or aspherical surface and can be provided with regular or irregular structures on one side or on both sides in order to improve the light characteristics, with the axis of the lens 11 being aligned with respect to the axis 8 of the reflector 2. The upper edge 16 of the shutter 12 is projected by the projection lens 9 as an asymmetric light/dark boundary onto the roadway in front of the motor vehicle. Asymmetric means that the range of the light distribution on the vehicle's own side (on the right-hand roadway side when driving on the right) is greater than on the opposing traffic side (on the left-hand side of the roadway when driving on the right). The asymmetric light/dark boundary of the light distribution may, for example, be provided by a 15° rise or by a step in the upper edge 16 of the shutter 12. The upper edge 16 of the shutter 12 is preferably arranged in the area of the second focal point of the reflector 2.

The shutter arrangement 12 may be designed to be movable in order to vary the light distribution. For example, it is possible for flapping of the entire shutter 12 about a rotation axis which runs essentially horizontally transversely with respect to the optical axis 8 of the reflector 2. It would also be feasible for the shutter 6 to have a static shutter element and at least one shutter element which can move relative to the static element, with the movable shutter element being movable about a horizontal rotation axis which runs essentially parallel to the optical axis 8. By flapping of the entire shutter 12 or by movement of the movable shutter element, the upper edge 16 of the shutter 12 is entirely or partially raised or lowered. The distribution of the light emerging from the headlights or light module 1 can be varied by movement of the shutter 12 or of the movable shutter element, in the simplest case by switching between a dipped light and main beam, or in a further-developed case in order to provide an adaptive light distribution, for example in order to produce a freeway light, country-road light, town light, bad-weather light, etc. A control unit 14 is provided in order to move the shutter 12 for the adaptive light distribution, and may be in the form of an electric motor, preferably a stepping motor, or an electromagnet. In addition, the shutter 12 may have a further shutter element which can move about a horizontal pivoting axis which runs essentially parallel to the optical axis 8 of the reflector 2, and which is used for switching the light distribution between driving on the right and driving on the left.

Figure 13:
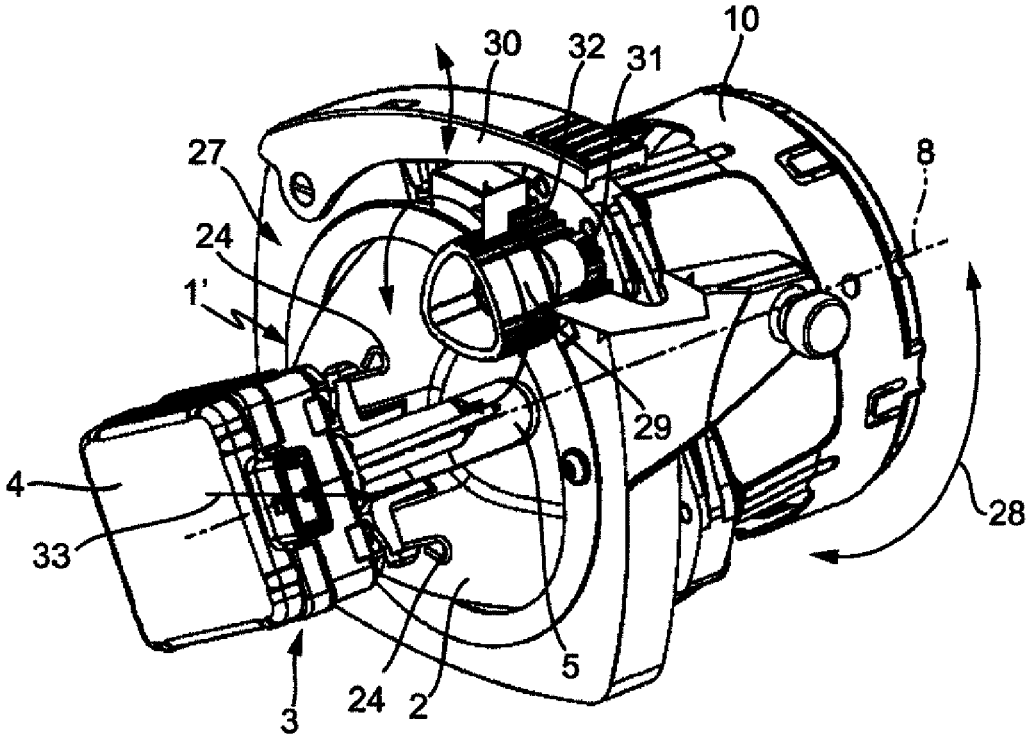
FIG. 13 shows a perspective view of a fifth preferred embodiment of a light module.
Figure 15:
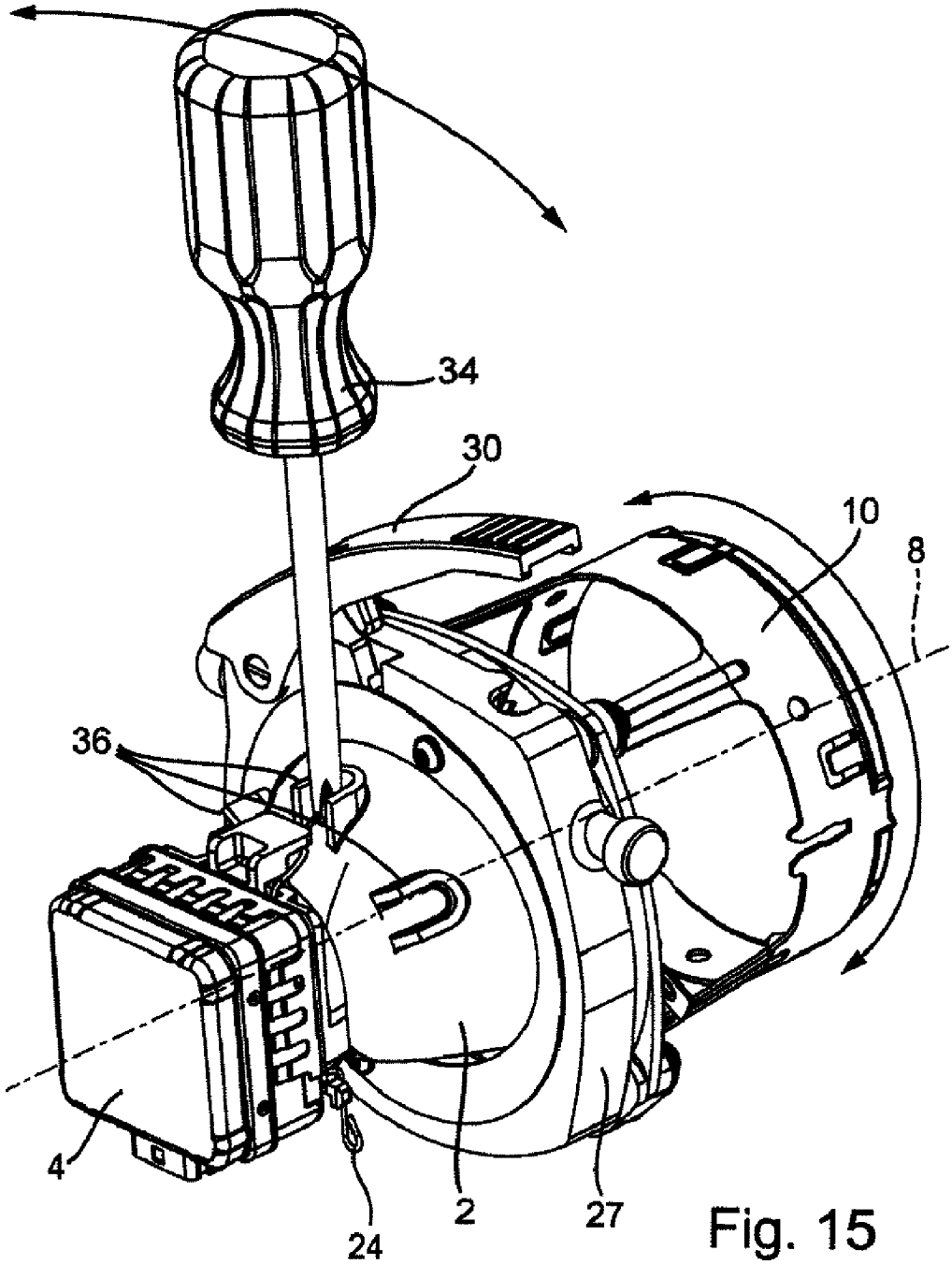
FIG. 15 shows a perspective view of a seventh preferred embodiment of a light module.

The light module 1 is arranged in a headlight housing, which is not illustrated in FIG. 1, either on its own or together with further light modules which may be in the form of a PES module or a reflection module. In the light propagation direction, the housing has a light outlet opening which is closed by a transparent covering glass, which is likewise not illustrated, with or without optically acting profiles. In order to provide beam width control the entire light module 1 can be designed such that it can pivot about a horizontal pivoting axis which runs essentially transversely with respect to the optical axis 8 of the reflector 2. Corresponding mountings, by means of which the module 1 is mounted on the headlight housing or on a further holding frame such that it can pivot about the pivoting axis, are illustrated for example in FIGS. 13, 14 and 15. Furthermore, in order to provide a dynamic turning light function, the light module 1 can be mounted in the headlight housing or in a further holding frame such that it can rotate about a rotation axis which runs essentially vertically and transversely with respect to the optical axis 8 of the reflector 2, with the horizontal axis for a beam width control function and the vertical axis for a dynamic turning light function intersecting in the vicinity of the center point on the enveloping sphere of the lens surface at the rear in the light propagation direction (that is to say the lens surface which can be seen through the glass covering the headlight), in order to achieve a minimal gap between the module 1 and the surrounding design surfaces (for example metalized covering glasses). The beam width control function, the turning light function and the adaptive light distribution by movement of the shutter 12 will not be described in any more detail here.

In order to allow the light source 3 to be replaced particularly easily, in particular in a very confined space, the reflector 2 and the reflector neck 9 have a slot 17 below the holding opening 7, which slot 17 extends into the holding opening 7. The width of the slot 17 is chosen such that the light-emitting part of the lamp 3 passes through it. In the case of a light source 3 which is in the form of a gas discharge lamp, the glass bulb 5 in which the arc is produced forms the light-emitting part. In the case of some other type of light source, the light-emitting part of the light source is designed in a correspondingly different manner. For example, in the case of an LED light source, it would be feasible for the light source 3 to have one or more LEDs (light-emitting diodes) which are mounted on and with which contact is made on a chip, and which would then form the light-emitting part of the light source 3. The length of the slot 17 corresponds at least to half the length of the light-emitting part 5 of the light source 3. The length of the slot 17 is preferably chosen such that the entire length of the light-emitting part 5 of the lamp 3 can be passed outwards through the slot 17.

In this case, the slot 17 has approximately the same length as the glass bulb 5 from its distal end to its shank.

The lamp 3 can be withdrawn directly downward through the slot 17, and its entire length need not be drawn out of the reflector 2. This measure makes it possible to reduce the physical space required in the longitudinal direction for lamp replacement, or even to avoid it completely. Since the area of the reflector 2 directly below the lamp 3 is of minor importance for lighting purposes, the slot 17 for lamp replacement can be incorporated here without any need to be concerned about major reductions in lighting.

An arrow 18 in FIG. 1 indicates that the lamp 3 or the igniter 4 is pivoted downward after being released from the reflector neck 9, and can then be removed. Alternatively, it is feasible for the igniter 4 to be pivoted upward about a horizontal rotation axis (not shown) which runs transversely with respect to the optical axis 8 and at a distance from it, once the lamp 3 has been released. In this case, the glass bulb 5 is pivoted downward out of the interior of the reflector 2 through the slot 17. The lamp 3 could then be removed upward.

Figure 2:
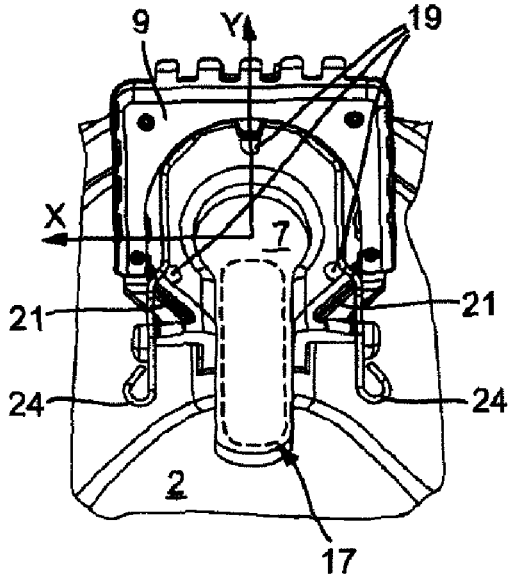
FIG. 2 shows a second preferred embodiment of a light module according to the invention, in a view in the light emission direction Z.
Figure 3:
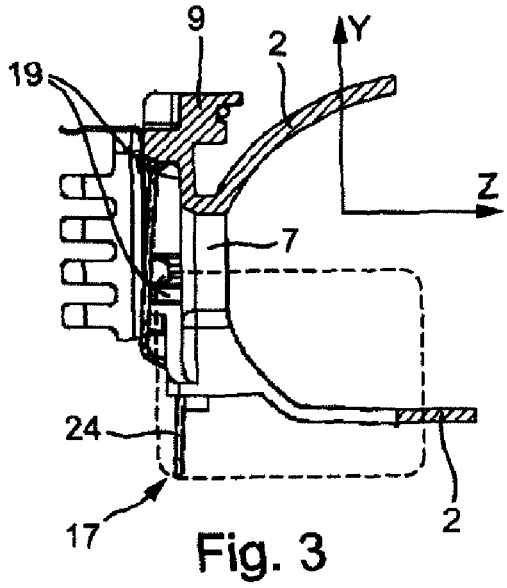
FIG. 3 shows a detail of the light module shown in FIG. 2, in the form of a longitudinal section.

FIGS. 2 and 3 show the arrangement and configuration of the slot 17 in detail. The lamp 3 can be removed through the slot 17 downward (in the −Y direction) transversely with respect to the optical axis 8, with the glass bulb 5 being moved outward through the slot 17 from the reflector interior. In this case, the lamp 3—as indicated by the arrow 18 in FIG. 1—can first of all be moved translationally downward, and can then be pivoted downward, with its igniter 4, about a horizontal, virtual rotation axis which runs transversely with respect to the optical axis 8. The rotation axis is preferably located below the optical axis, in the area of the glass bulb 5, and preferably in the front area of the glass bulb 5. Alternatively, the lamp 3 can be also be removed upward (in the +Y direction) through the slot 17. In this case, the lamp 3 is first released from the reflector neck 9. The igniter 4 is then pivoted upward, in the opposite direction to the arrow 18, about a horizontal, virtual rotation axis which runs transversely with respect to the optical axis 8. In the process, the glass bulb is pivoted downward and outward through the slot 17.

Figure 4:
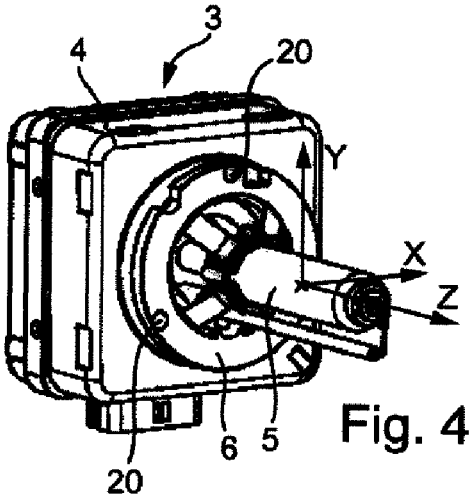
FIG. 4 shows a perspective view of a preferred light source for use with the light module according to the invention.
Figure 5:
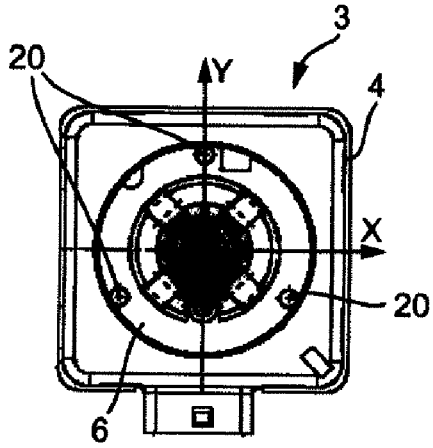
FIG. 5 shows a view in the opposite direction to the light emission direction of the light source shown in FIG. 4.
Figure 6:
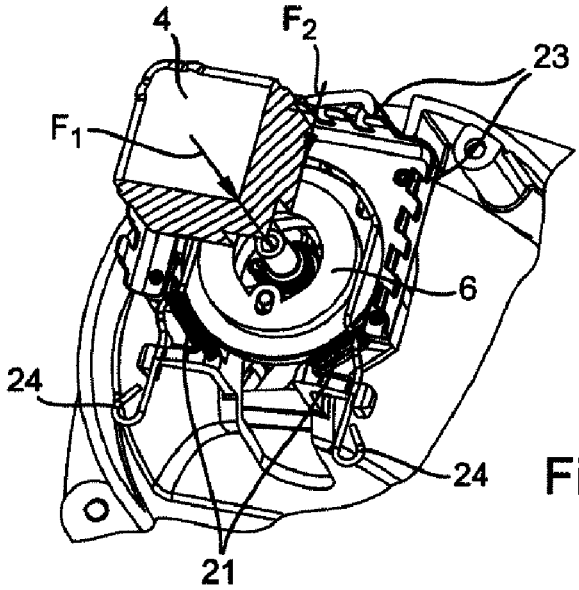
FIG. 6 shows a perspective view of a third preferred embodiment of a lamp holder for a light module according to the invention, with a light source, partially in the form of a section.
Figure 7:
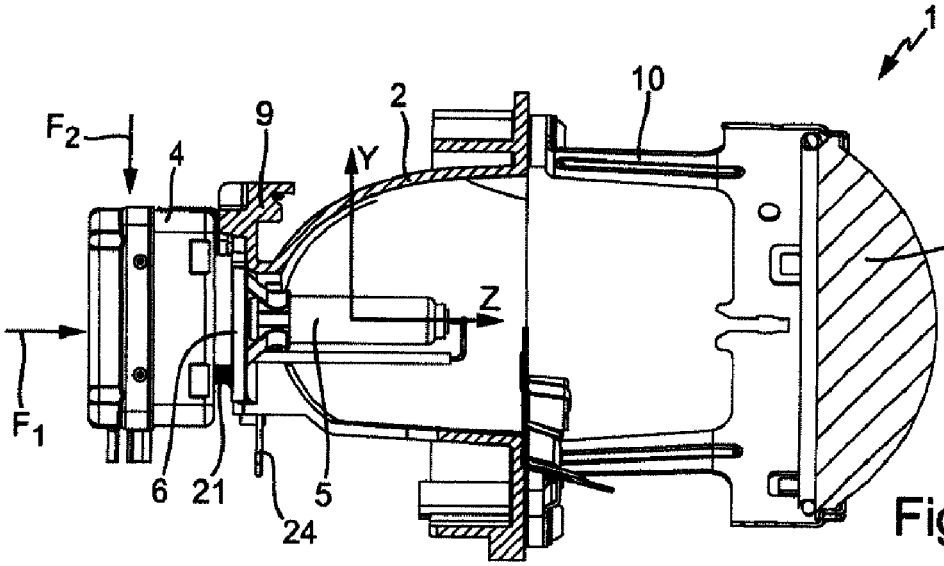
FIG. 7 shows a side view, partially in the form of a longitudinal section, of the light module shown in FIG. 6.
Figure 8:
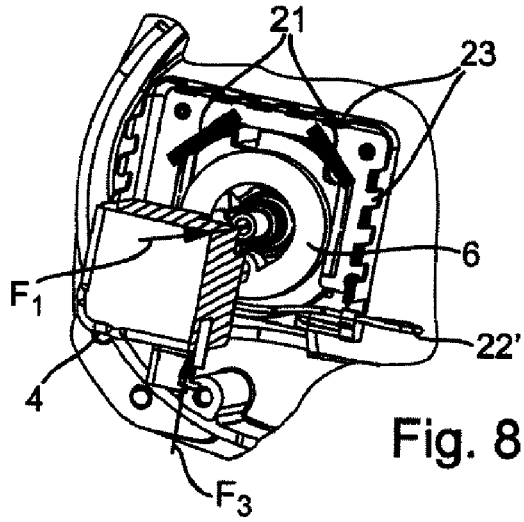
FIG. 8 shows a perspective view of a fourth preferred embodiment of a lamp holder of a light module according to the invention with a light source, partially in the form of a section.
Figure 9:
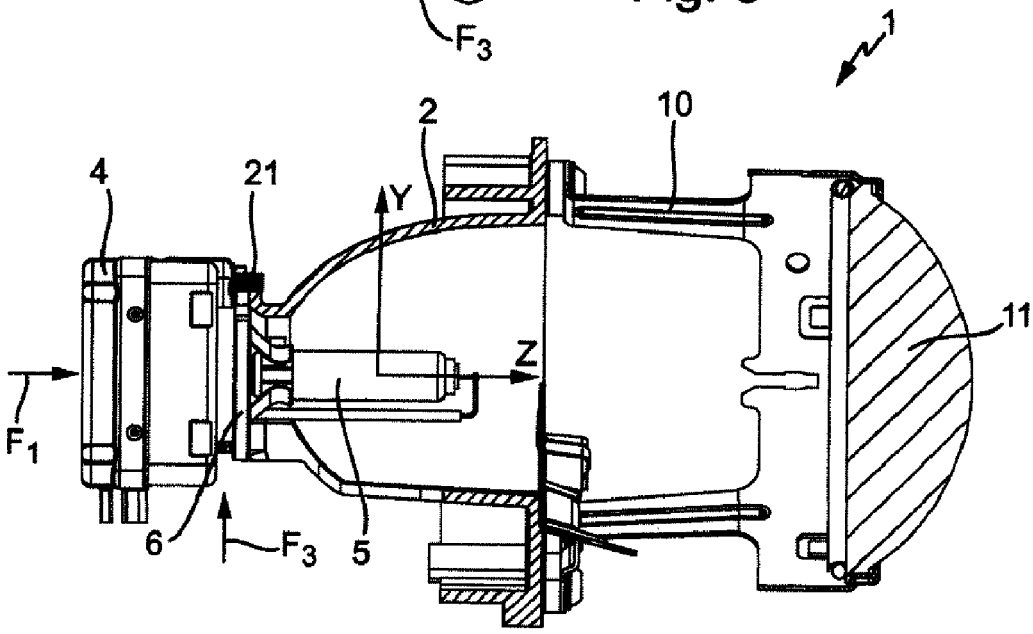
FIG. 9 shows a side view, partially in the form of a longitudinal section, of the light module shown in FIG. 8.
Figure 10:
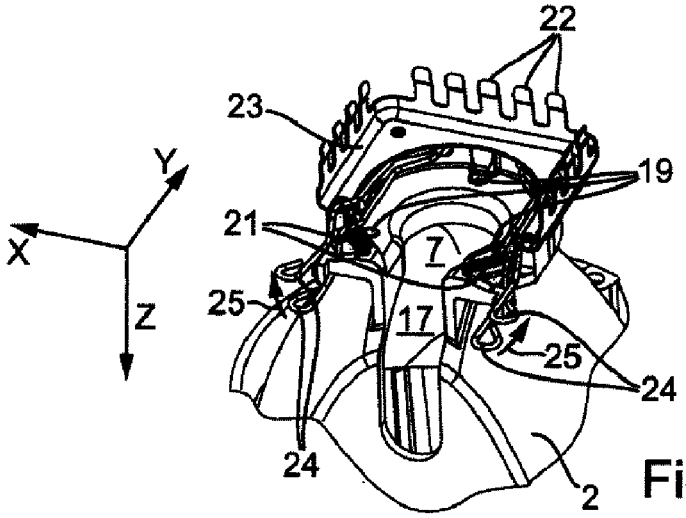
FIG. 10 shows a perspective view of the lamp holder shown in FIGS. 6 and 7.
Figure 11:
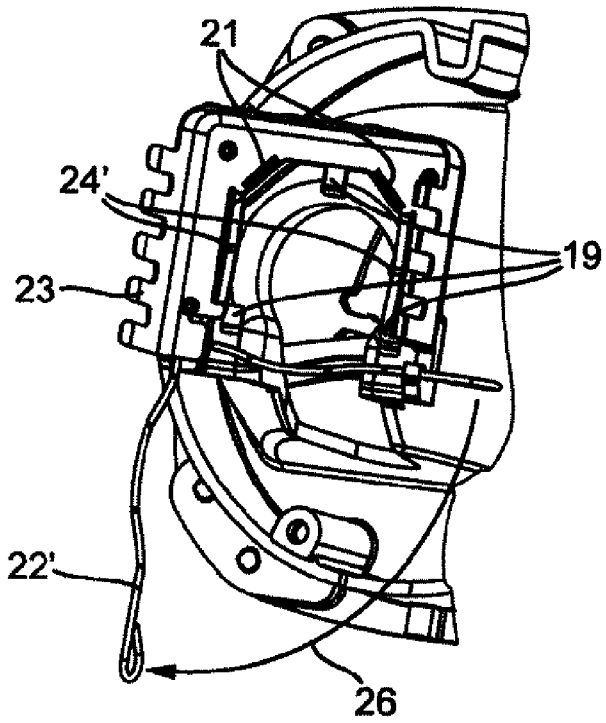
FIG. 11 shows a perspective view of the lamp holder shown in FIGS. 8 and 9.

The lamp holder or the reflector neck 9 has contact surfaces 19 for at least three contact points 20 (cf. FIGS. 4 and 5) of the lamp 3. The lamp 3 is pressed against these contact surfaces 19 with the aid of at least one spring 24, and is in this way positioned in the Z direction. In FIGS. 2, 3, 6, 7 and 10, the spring 24 is in the form of a double-limbed spring, in which case the spring limbs can be detached and pivoted away in order to replace the lamp (cf. the arrow 25 in FIG. 10). In FIGS. 8, 9 and 11, the springs 24 are in the form of C-bending springs 24'. Both types of springs 24 push the cap 6 of the lamp 3 in the +Z direction.

Furthermore, the lamp holder 9 has two prismatic surfaces 21, against which the cylindrical flange or lamp cap 6 of the lamp 3 is pressed in the Y direction via at least one further spring 22. In the exemplary embodiment shown in FIGS. 6, 7 and 10, the further spring 22 has a plurality of spring lugs 22 of a spring basket 23, which makes contact with the igniter 4 and the reflector 2 for EMC shielding, and which spring lugs 22 press the lamp 3 with its cylindrical centering collar 6 in the −Y direction against the contact prism 21. In the exemplary embodiment shown in FIGS. 8, 9 and 11, the further spring has a shaped wire spring in the form of a spring clip 22', whose spring limb can be detached in order to replace the lamp 3, and can be pivoted away to a release position (cf. the arrow 26 in FIG. 11), and which, in its locking position, pushes the cylindrical centering collar 6 of the lamp 3 in the +Y direction into the contact prism 21. The lamp 3 is also positioned in the X and Y directions, in conjunction with the contact prism 21, by the further spring or springs 22.

The forces exerted on the lamp cap 6 by the springs 22, 24 are likewise shown in FIGS. 6 to 9. In the exemplary embodiment shown in FIGS. 6 and 7, spring forces F1 and F2 act in the +Z direction and in the −Y direction. In the exemplary embodiment shown in FIGS. 8 and 9, spring forces F1 and F3 act in the +Z direction and in the +Y direction. Both the springs 24 and the further springs 22 may be in the form of shaped wire springs or shaped bending springs. At least one of the springs 22, 24 can be unlocked and pivoted away (see the arrow 25 in FIG. 10 and the arrow 26 in FIG. 11), in order to allow the lamp 3 to be removed.

Both springs 22, 24 can advantageously be formed integrally in a shaped wire spring or shaped bending spring. A contact spring or a spring basket 23, which makes an electrical connection between the lamp igniter 4 and the reflector 2 for EMC shielding purposes, can be used particularly advantageously to integrate at least one of the two springs, that is to say to form it or them in one piece (cf. the spring lugs 22 in FIG. 10 and the C-bending springs 24' in FIG. 11). The spring function of one of the springs 22; 24' is therefore integrated in the actual contact-making function of the spring basket 23.

Furthermore, the headlight insert 1'—comprising the light source 3, the reflector 2, the shutter arrangement 12, the supporting element 10 and the projection lens 11—can be mounted with the proposed lamp holder 9 in a holding frame 27 (illustrated partially in the form of a section in FIG. 13) such that it can rotate about the optical axis 8 (cf. the double-headed arrow 28). This also allows the removal direction of the lamp 3 to be rotated with the headlight insert 1' (maintenance position of the light module 1), thus making it possible to provide different directions for lamp replacement. One example of a lamp removal direction is indicated by the arrow 33 in FIG. 13.

The holding frame 27 has mountings for the headlight insert 1', for a control wheel 29 and for a latching lever 30. The control wheel 29 has a tooth system 31 in the form of a pinion, which engages in a toothed rim 32 on the reflector 2 of the headlight insert 1', and can therefore rotate the latter about its optical axis 8. The latching lever 30 is mounted on the holding frame 27 about a rotation axis which runs parallel to and at a distance from the optical axis 8. At the same time, it can be latched into the holding frame 27 and the reflector 2. With a latching tab, it locks the headlight insert 1' in a desired null position (operating position of the light module 1). The lever 30 which is arranged in a defined position relative to the holding frame 27 can be latched in the reflector 2 only when the insert 1' is in the null position (for example with the light/dark boundary running horizontally). When the insert 1' has been latched in, this prevents the insert 1' from being moved, for example by means of the control wheel 29.

The control wheel 29 may optionally also be driven via a flexible shaft. This makes it possible to position the drive for the rotation mechanism largely freely on the headlight housing. The design and method of operation of the rotation mechanism are described in detail in DE 10 2008 011 170, filing date Feb. 26, 2008. Reference is expressly made to this document.

Furthermore, it is feasible for the control wheel 29 to have operating means contact surfaces (for example for a hexagonal wrench) which allow the control wheel 29 to be moved, for example, by means of a cross-headed, Torx or hexagonal screw wrench.

Alternatively, instead of the control wheel 29, a screwdriver 34 with a cross-headed, Torx or some other tooth system can engage directly in a tooth system 38 (for example a crown-wheel tooth system) which engages therewith, on the reflector 2. One example of a corresponding embodiment is shown in FIG. 14. In this embodiment, there is no need for the control wheel 29, and the holding frame 27 has just one groove 35 or hole for holding and for lateral support of the operating means 34.

Alternatively or additionally, the reflector 2 may also have one or more radial holes 36, grooves or ribs, into which an operating means in the form of a web, for example in the form of a screwdriver 34, or some other auxiliary tool can be inserted as a lever. This makes it easier to rotate the headlight insert 1' about the optical axis 8 for lamp replacement.

Finally, it is also feasible for the headlight insert 1' not to be moved manually, but by an electrical drive, for example by an electric motor or an electrical gearbox motor. In order to simplify the removal and the insertion of a light source 3 from and into the light module 1 of the lighting device, guide means can be provided, which guide the light source 3 on its path from the inserted position to the removed position, and vice versa. This ensures that, even if there is a minimal amount of physical space available for lamp replacement behind the light module 1, the lamp 3 will not become wedged or jammed between the light module 1 and the lighting device, or other auxiliary appliances in the vehicle, during lamp replacement. The guide means can provide the lamp 3 with any desired movement in three-dimensional space during lamp replacement. The physical space available for lamp replacement is utilized optimally by the guide means. Furthermore, this prevents the lamp 3 from being able to fall during lamp replacement.

The invention claimed is:

1. A light module for a lighting device for a motor vehicle, the lighting module comprising a light source for emission of electromagnetic radiation in the form of light which is visible for the human eye, and a reflector for focusing the emitted radiation, with the reflector having, at its apex in the area of its optical axis, an opening for holding a light-emitting part of the light source, and a reflector neck is formed on the reflector, surrounding at least a part of the holding opening, to which reflector neck another part of the light source is attached, wherein the reflector has a slot, which extends into the holding opening below the holding opening, the width of which slot transversely with respect to the optical axis of the reflector is greater than the width of the light-emitting part of the light source.

2. The light module as claimed in claim 1, wherein the length of the slot corresponds to the length of the light-emitting part of the light source.

3. The light module as claimed in claim 2, characterized in that the light module is in the form of a projection module which, looking in the light outlet direction, comprises, one behind the other, a reflector which is in the form of an ellipsoid or is similar to an ellipsoid, a shutter arrangement and a projection lens.

4. The light module as claimed in claim 3, wherein the reflector neck has a cutout above the holding opening, the width of which cutout transversely with respect to the optical axis of the reflector is greater than the width of the light-emitting part of the light source.

5. The light module as claimed in claim 4, wherein the reflector is designed such that specific areas of a reflection surface of the reflector reflect radiation emitted from the light source in a resultant light distribution to where those areas of the reflection surface of the reflector which are not present because of the slot, actually would have reflected radiation.

6. The light module as claimed in claim 5, wherein the light source is in the form of a gas discharge lamp with a power of 25 watts, and a maximum luminous flux of 2000 lumens.

7. The light module as claimed in claim 6, wherein the reflector neck has a contact surface on which at least there contact points of the light source rest in order to position the light source in the Z direction when the light source is being used.

8. The light module as claimed in claim 7, wherein at least one first spring element presses the contact points of the light source against the contact surface of the reflector neck.

9. The light module as claimed in claim 8, wherein the reflector neck has at least two prismatic surfaces, and a second spring element is provided, which presses the light source against the prismatic surfaces in order to position the light source in the X and Y directions when the light source is being used.

10. The light module as claimed in claim 9, wherein at least one of the spring elements can be unlocked and pivoted away.

11. The light module as claimed in claim 10, wherein at least one of the spring elements is an integral component of a contact-making means for making an electrical connection between a lamp igniter of the light source and the reflector.

12. A lighting device for a motor vehicle, in particular a motor vehicle headlight, having a light module comprising a light source for emission of electromagnetic radiation in the form of light which is visible for the human eye, and a reflector for focusing the emitted radiation, with the reflector having, at its apex in the area of its optical axis, an opening for holding a light-emitting part of the light source, and a reflector neck is formed on the reflector, surrounding at least a part of the holding opening, to which reflector neck another part of the light source is attached, wherein the light module is designed as claimed in claim 11.

13. The lighting device as claimed in claim 12, wherein the lighting device has a holding frame on which the light module is mounted such that it can rotate about the optical axis of the reflector between an operating position and a maintenance position.

14. The lighting device as claimed in claim 13, wherein the lighting device has guide means which guide the light source on its path from the inserted position to the removed position, and vice versa.

* * * * *